US007752989B2

(12) United States Patent
Paz et al.

(10) Patent No.: US 7,752,989 B2
(45) Date of Patent: Jul. 13, 2010

(54) DEEP WATER HIGH CAPACITY ANCHORING SYSTEM AND METHOD OF OPERATION THEREOF

(75) Inventors: Vladimir Mate Paz, Petropolis (BR); Elisabeth de Campos Porto, Rio de Janeiro (BR); Cipriano José De Medeiros, Júnior, Rio de Janeiro (BR)

(73) Assignee: Petróleo Brasileiro S.A. - Petrobras, Rio de Janeiro (BR)

( * ) Notice: Subject to any disclaimer, the term of this patent is extended or adjusted under 35 U.S.C. 154(b) by 0 days.

(21) Appl. No.: 12/081,543

(22) Filed: Apr. 17, 2008

(65) Prior Publication Data

US 2009/0020065 A1 Jan. 22, 2009

(30) Foreign Application Priority Data

Jul. 16, 2007 (BR) ..... 0702973

(51) Int. Cl.
*B63B 21/26* (2006.01)

(52) U.S. Cl. ..... 114/295; 405/224

(58) Field of Classification Search ..... 114/294, 114/295, 297, 303; 405/224, 236
See application file for complete search history.

(56) References Cited

U.S. PATENT DOCUMENTS

| | | | | |
|---|---|---|---|---|
| 3,431,879 | A | 3/1969 | Westling | |
| 3,518,957 | A | 7/1970 | George | |
| 3,965,687 | A * | 6/1976 | Shaw | 405/226 |
| 4,086,866 | A * | 5/1978 | Nixon | 114/295 |
| 4,095,550 | A * | 6/1978 | Kerr | 114/295 |
| 4,347,802 | A * | 9/1982 | Hossfeld | 114/295 |

* cited by examiner

*Primary Examiner*—Lars A Olson
(74) *Attorney, Agent, or Firm*—Nixon & Vanderhye PC

(57) ABSTRACT

A deep water high capacity anchoring system in which the fixing of an anchor structure under compact layers of ocean soil is reached by jetting fluid in rising directions and, simultaneously in a radial and/or perpendicular direction to the external surfaces of said anchor structure injected from its lower extremity, thus guaranteeing anchoring of large size floating structures, related to the petroleum industry, such as stationary production units and oil drilling platforms.

9 Claims, 9 Drawing Sheets

FIG. 7

TABLE 1

| Depth (m) | Su (KPa) | θ (m) | Area ($m^2$) | Qu (t) |
|---|---|---|---|---|
| 15 | 35 | 2,0 | 3,1 | 110 |
| 20 | 45 | 2,0 | 3,1 | 141 |
| 25 | 55 | 2,0 | 3,1 | 173 |
| 30 | 65 | 2,0 | 3,1 | 204 |
| 35 | 75 | 2,0 | 3,1 | 236 |
| 40 | 85 | 2,0 | 3,1 | 267 |
| 15 | 35 | 2,5 | 4,9 | 172 |
| 20 | 45 | 2,5 | 4,9 | 221 |
| 25 | 55 | 2,5 | 4,9 | 270 |
| 30 | 65 | 2,5 | 4,9 | 319 |
| 35 | 75 | 2,5 | 4,9 | 368 |
| 40 | 85 | 2,5 | 4,9 | 417 |
| 15 | 35 | 3,0 | 7,1 | 247 |
| 20 | 45 | 3,0 | 7,1 | 318 |
| 25 | 55 | 3,0 | 7,1 | 389 |
| 30 | 65 | 3,0 | 7,1 | 459 |
| 35 | 75 | 3,0 | 7,1 | 530 |
| 40 | 85 | 3,0 | 7,1 | 601 |
| 15 | 35 | 3,5 | 9,6 | 337 |
| 20 | 45 | 3,5 | 9,6 | 433 |
| 25 | 55 | 3,5 | 9,6 | 529 |
| 30 | 65 | 3,5 | 9,6 | 625 |
| 35 | 75 | 3,5 | 9,6 | 722 |
| 40 | 85 | 3,5 | 9,6 | 818 |

| Depth (m) | Su (KPa) | θ (m) | Area ($m^2$) | Qu (t) |
|---|---|---|---|---|
| 15 | 35 | 4,0 | 12,6 | 440 |
| 20 | 45 | 4,0 | 12,6 | 565 |
| 25 | 55 | 4,0 | 12,6 | 691 |
| 30 | 65 | 4,0 | 12,6 | 817 |
| 35 | 75 | 4,0 | 12,6 | 942 |
| 40 | 85 | 4,0 | 12,6 | 1,068 |
| 15 | 35 | 4,5 | 15,9 | 557 |
| 20 | 45 | 4,5 | 15,9 | 716 |
| 25 | 55 | 4,5 | 15,9 | 875 |
| 30 | 65 | 4,5 | 15,9 | 1,034 |
| 35 | 75 | 4,5 | 15,9 | 1,193 |
| 40 | 85 | 4,5 | 15,9 | 1,352 |
| 15 | 35 | 5,0 | 19,6 | 687 |
| 20 | 45 | 5,0 | 19,6 | 884 |
| 25 | 55 | 5,0 | 19,6 | 1,080 |
| 30 | 65 | 5,0 | 19,6 | 1,276 |
| 35 | 75 | 5,0 | 19,6 | 1,473 |
| 40 | 85 | 5,0 | 19,6 | 1,669 |
| 15 | 35 | 5,5 | 23,8 | 832 |
| 20 | 45 | 5,5 | 23,8 | 1,069 |
| 25 | 55 | 5,5 | 23,8 | 1,307 |
| 30 | 65 | 5,5 | 23,8 | 1,544 |
| 35 | 75 | 5,5 | 23,8 | 1,782 |
| 40 | 85 | 5,5 | 23,8 | 2,019 |

Obs: Su – 5 + 4z
Highlighted, estimate of load capacities above 800 tons

FIG. 8

TABLE 2

| Depth (m) | Su (KPa) | θ (m) | Area ($m^2$) | Qu (t) |
|---|---|---|---|---|
| 15 | 50 | 2,0 | 3,1 | 157 |
| 20 | 65 | 2,0 | 3,1 | 204 |
| 25 | 80 | 2,0 | 3,1 | 251 |
| 30 | 95 | 2,0 | 3,1 | 298 |
| 35 | 110 | 2,0 | 3,1 | 346 |
| 40 | 125 | 2,0 | 3,1 | 393 |
| 15 | 50 | 2,5 | 4,9 | 245 |
| 20 | 65 | 2,5 | 4,9 | 319 |
| 25 | 80 | 2,5 | 4,9 | 393 |
| 30 | 95 | 2,5 | 4,9 | 466 |
| 35 | 110 | 2,5 | 4,9 | 540 |
| 40 | 125 | 2,5 | 4,9 | 614 |
| 15 | 50 | 3,0 | 7,1 | 353 |
| 20 | 65 | 3,0 | 7,1 | 459 |
| 25 | 80 | 3,0 | 7,1 | 565 |
| 30 | 95 | 3,0 | 7,1 | 672 |
| 35 | 110 | 3,0 | 7,1 | 778 |
| 40 | 125 | 3,0 | 7,1 | 884 |
| 15 | 50 | 3,5 | 9,6 | 481 |
| 20 | 65 | 3,5 | 9,6 | 625 |
| 25 | 80 | 3,5 | 9,6 | 770 |
| 30 | 95 | 3,5 | 9,6 | 914 |
| 35 | 110 | 3,5 | 9,6 | 1,058 |
| 40 | 125 | 3,5 | 9,6 | 1,203 |

| Depth (m) | Su (KPa) | θ (m) | Area ($m^2$) | Qu (t) |
|---|---|---|---|---|
| 15 | 50 | 4,0 | 12,6 | 628 |
| 20 | 65 | 4,0 | 12,6 | 817 |
| 25 | 80 | 4,0 | 12,6 | 1,005 |
| 30 | 95 | 4,0 | 12,6 | 1,194 |
| 35 | 110 | 4,0 | 12,6 | 1,382 |
| 40 | 125 | 4,0 | 12,6 | 1,571 |
| 15 | 50 | 4,5 | 15,9 | 795 |
| 20 | 65 | 4,5 | 15,9 | 1,034 |
| 25 | 80 | 4,5 | 15,9 | 1,272 |
| 30 | 95 | 4,5 | 15,9 | 1,511 |
| 35 | 110 | 4,5 | 15,9 | 1,749 |
| 40 | 125 | 4,5 | 15,9 | 1,988 |
| 15 | 50 | 5,0 | 19,6 | 982 |
| 20 | 65 | 5,0 | 19,6 | 1,276 |
| 25 | 80 | 5,0 | 19,6 | 1,571 |
| 30 | 95 | 5,0 | 19,6 | 1,865 |
| 35 | 110 | 5,0 | 19,6 | 2,160 |
| 40 | 125 | 5,0 | 19,6 | 2,454 |
| 15 | 50 | 5,5 | 23,8 | 1,188 |
| 20 | 65 | 5,5 | 23,8 | 1,544 |
| 25 | 80 | 5,5 | 23,8 | 1,901 |
| 30 | 95 | 5,5 | 23,8 | 2,257 |
| 35 | 110 | 5,5 | 23,8 | 2,613 |
| 40 | 125 | 5,5 | 23,8 | 2,970 |

Obs: Su – 5 + 3z
Highlighted, estimate of load capacities above 800 tons

FIG. 9

TABLE 3

| Depth (m) | Su (KPa) | θ (m) | Area ($m^2$) | Qu (t) |
|---|---|---|---|---|
| 15 | 65 | 2,0 | 3,1 | 204 |
| 20 | 85 | 2,0 | 3,1 | 267 |
| 25 | 105 | 2,0 | 3,1 | 330 |
| 30 | 125 | 2,0 | 3,1 | 393 |
| 35 | 145 | 2,0 | 3,1 | 456 |
| 40 | 165 | 2,0 | 3,1 | 518 |
| 15 | 65 | 2,5 | 4,9 | 319 |
| 20 | 85 | 2,5 | 4,9 | 417 |
| 25 | 105 | 2,5 | 4,9 | 515 |
| 30 | 125 | 2,5 | 4,9 | 614 |
| 35 | 145 | 2,5 | 4,9 | 712 |
| 40 | 165 | 2,5 | 4,9 | 810 |
| 15 | 65 | 3,0 | 7,1 | 459 |
| 20 | 85 | 3,0 | 7,1 | 601 |
| 25 | 105 | 3,0 | 7,1 | 742 |
| 30 | 125 | 3,0 | 7,1 | 884 |
| 35 | 145 | 3,0 | 7,1 | 1,025 |
| 40 | 165 | 3,0 | 7,1 | 1,166 |
| 15 | 65 | 3,5 | 9,6 | 625 |
| 20 | 85 | 3,5 | 9,6 | 818 |
| 25 | 105 | 3,5 | 9,6 | 1,010 |
| 30 | 125 | 3,5 | 9,6 | 1,203 |
| 35 | 145 | 3,5 | 9,6 | 1,395 |
| 40 | 165 | 3,5 | 9,6 | 1,587 |

| Depth (m) | Su (KPa) | θ (m) | Area ($m^2$) | Qu (t) |
|---|---|---|---|---|
| 15 | 65 | 4,0 | 12,6 | 817 |
| 20 | 85 | 4,0 | 12,6 | 1,068 |
| 25 | 105 | 4,0 | 12,6 | 1,319 |
| 30 | 125 | 4,0 | 12,6 | 1,571 |
| 35 | 145 | 4,0 | 12,6 | 1,822 |
| 40 | 165 | 4,0 | 12,6 | 2,073 |
| 15 | 65 | 4,5 | 15,9 | 1,034 |
| 20 | 85 | 4,5 | 15,9 | 1,352 |
| 25 | 105 | 4,5 | 15,9 | 1,670 |
| 30 | 125 | 4,5 | 15,9 | 1,988 |
| 35 | 145 | 4,5 | 15,9 | 2,306 |
| 40 | 165 | 4,5 | 15,9 | 2,624 |
| 15 | 65 | 5,0 | 19,6 | 1,276 |
| 20 | 85 | 5,0 | 19,6 | 1,669 |
| 25 | 105 | 5,0 | 19,6 | 2,062 |
| 30 | 125 | 5,0 | 19,6 | 2,454 |
| 35 | 145 | 5,0 | 19,6 | 2,847 |
| 40 | 165 | 5,0 | 19,6 | 3,240 |
| 15 | 65 | 5,5 | 23,8 | 1,544 |
| 20 | 85 | 5,5 | 23,8 | 2,019 |
| 25 | 105 | 5,5 | 23,8 | 2,495 |
| 30 | 125 | 5,5 | 23,8 | 2,970 |
| 35 | 145 | 5,5 | 23,8 | 3,445 |
| 40 | 165 | 5,5 | 23,8 | 3,920 |

Obs: Su – 5 + 4z
Highlighted, estimate of load capacities above 800 tons

DEEP WATER HIGH CAPACITY ANCHORING SYSTEM AND METHOD OF OPERATION THEREOF

CROSS REFERENCE TO RELATED APPLICATION

This application is based upon, claims the benefit of, priority of, and incorporates by reference, the contents of Brazilian Patent Application No. PI 0702973-0 filed Jul. 16, 2007.

FIELD OF THE INVENTION

This invention concerns an anchoring system by jetting applied to light anchors, with a high load capacity, which guarantees the anchoring of large size floating structures, involved in the petroleum industry, such as stationary production units and oil drilling platforms. More specifically, the invention also concerns a method for installing a high capacity anchor.

FUNDAMENTALS OF THE INVENTION

The petroleum industry when working in deep waters requires the use of floating platforms or stationary production units, which need to be anchored to the sea bed in order to operate as a production unit or for oil well exploration. This anchorage is made through an assembly of specific elements, which include anchoring lines, anchors, and means to fix the anchors to the sea bed.

Currently, there are several anchoring systems available that may be used according to the local installation conditions, and with the load that it will have to support, as follows: Drag Anchors, Torpedo Anchors, and Suction Anchors.

Torpedo Anchors are expensive and heavy, weighing up to 98 tons, and they require specific technical installation procedures and certification. These anchors may attain a depth of penetration into the sea bed of approximately 20 m.

Suction Anchors also require a burdensome, slow, and complex procedure for its installation, since it is necessary to use ships with horizontal positioning control and a compensator of vertical oscillation, without which it is not possible to implement suction anchoring. These anchors are generally made up of steel or concrete tubing of approximately 25 m in height, which are embedded up to their upper extremities to faces the surface of the sea floor. These anchors are heavy, voluminous and difficult to handle.

The two types of anchoring mentioned, the Torpedo Anchor and the Suction Anchor, are used on a floor that is not very compacted, and the depth in which they are installed, around 20 m, does not reach the most compacted layers of the marine subsoil.

There are still Drag Anchors which are more simple and lighter (weighing around 10 tons) when compared to those previously mentioned. This type of anchors is divided into two basic categories: Normal Drag Anchors and Vertical Load Drag Anchors, the latter being called in the technical jargon, "VLA" (Vertical Load Anchor).

In this anchoring implementation, so that the anchor may be properly embedded, ships capable of exerting a propulsion force (through the technical method known as "bollard pull") on the order of 600 tons or more, must be used, so that the anchor penetrates the ocean subsoil and guarantees a useful load capacity, without reaching the breakaway limit.

Within the field of knowledge concerning the anchorage of large size floating structures, U.S. Pat. No. 3,431,879 can be cited. In short, this patent mentions as its main characteristic, the fact that the anchor is shaped like a "balloon", in other words, a structure comprised of a shell that forms an empty inner space, which must be filled with sediment from the ocean floor itself.

The use of this anchor is restricted to use on an ocean floor made up of non-consolidated material, and is not usable on compact ocean floors. The greatest advantage of the anchor cited in the U.S. Pat. No. 3,431,879 is that it can be removed by withdrawing the sediment of supply, which propitiate a lighter structure favoring its transfer to another location. However, the need for a diver is also mentioned for said operation.

The penetration of said anchor on the sea floor may occur as a consequence of an alternative process of the stuffing the anchor's body with local sediment. A cavitation below the anchor is induced by suctioning the ocean floor, or in other words, the injection of a fluid inside the balloon provokes the indirect suctioning of the soil underneath the anchor towards its interior.

Clearly, the great advantage proposed in U.S. Pat. No. 3,431,879 is placing an anchor of light structure available to be located and relocated, and at the same time heavy enough when filled with sediment, to provide satisfactory anchorage over the weakest upper sea bed.

Yet in the technique related to anchoring, U.S. Pat. No. 3,518,957 can be mentioned. Fundamentally, this patent reveals an element of temporary anchorage for frequent reuse. Its operational principle is based on the induction of a fluid flow through the interior of its principal tubular body, by directing jets of this fluid into its embedded extremities, and thus facilitating its removal. This facilitation is obtained simply by demobilizing the adjacent sea bed floor, with a combination of jetting fluid and impact.

The conclusion is that said solution does not provide for embedding the anchor deeply into the ocean floor; it will not work within the realities of anchoring oil platforms, which are structures that demand a great load over their anchorage and require anchor elements to be placed in the deep layers of the ocean floor, with greater passive resistance.

Considering even another angle within large structure anchorage knowledge, the use of pre-molded stakes employed in civil construction for building foundations, particularly those situated in costal regions, may be mentioned. Usually these foundations are placed by jetting into very compacted sandy land.

In short, this technique consists of concreting a stake having a pipeline disposed longitudinally in its center in such a way that allows water to be pumped as far as its lower extremity.

The water disaggregates the sand in the point of the stake and allows it to penetrate simply by its own weight. Once the approximate depth specified for the project is attained, the jetting is substituted by the piling (by using a pile driver) to mobilize the resistance of the sandy floor, until a negligible displacement is attained by a certain number of blows on the pylon.

This invention seeks to create a new anchoring option, of technical application in a simple way and economically more viable.

As a result of research into this subject, it was created the deep water high capacity anchoring system herein proposed and a method for its implementation.

The concern during the development of this new anchoring system and method of installation seek to simplify anchoring and make it less expensive, offering one more option for high load capacity anchorage, applicable as anchoring support for large structures floating in choppy water at great depth.

The invention described below originates from the continue research in technologies of anchorage, objectifying to simplify, to reduce costs in the anchoring operations and to provide a structural high efficiency solution.

Other purposes that the deep water high capacity anchoring system and its method of operation, object of this invention, seek to accomplish are listed below:

a. Lower cost, of materials as well as handling.

b. Make a highly effective structural anchoring option available (low weight×high load capacity), c. Application is little influenced by the geological profile of the anchoring location.

d. Absence of global bending due to higher compactness in the structural form.

e. The majority of the structural elements may be made of flat plates of steel, which makes its construction cheaper.

f. Possibility to eliminate the need for more than one ship to launch and install (all) the anchoring system.

g. Possibility for underwater pumping, increasing operational flexibility when adverse sea conditions make the operation difficult for ships.

h. Guarantee maximum efficiency when embedding the anchor with lower costs and simple procedures.

BRIEF SUMMARY OF THE INVENTION

This invention concerns a deep water high capacity anchoring system, in which the embedding of the anchoring structure is reach using fluid jetting in ascending directions, and (simultaneously) in a radial direction and/or perpendicular to the external surfaces.

First, the invention includes a metal anchoring structure, of a preponderantly conical shape provided with an anchor chain, which is cast in its entirety to the ocean floor from a handling ship. The handling ship also provides a pumping system which is inside the ship or is submerged, that injects a flow of liquid through a hose into one of the extremities of the anchoring system.

The anchoring structure has four basic and main functions:

1 - directs the upward movement of sediment from an eroded substrate under said anchoring structure.

2 - offers little resistance to fixing the anchor.

3 - at the same time offering high resistance to extract.

4 - propitiating its own descending vertical displacement by its own weight and by its external shape tending to be conical.

By virtue of these functions, the layout of the anchoring structure complies with a certain minimum parameters, such as: Features a circular cone-shaped layout, or pyramidal, with no less than three surfaces. Features an anchoring structure provided with a central body, the apex of which is provided with a jetting device. A fluid is injected into one of the extremities of the anchoring structure, through a hose. The fluid crosses through the inside of the main body of said anchoring structure and is expelled, in the form of a continuous and directed jet, through the jetting device, located in the other extremity.

The jetting device consists of a conical and solid directional conical tip with a series of holes or nozzles placed perpendicularly to the main axis of the central body, along the entire perimeter of the jetting device. Simultaneously, a second series of holes or nozzles placed along the entire perimeter of the same jetting device, which have their outlets turned towards the apex, so as to release the fluid in an ascending direction parallel to the lower external surface of the anchoring structure.

In an other aspect, the invention includes an operational method, which in short, comprises the following stages:

a) A handling ship casts the anchor attached to a cable;

b) Once the anchor is completely supported on the ocean floor, a fluid is pumped in and injected into the extremity of the anchoring structure;

c) Fluid jets are generated in the area of the anchoring structure's extremity, provoking a cavitation in the ocean floor;

d) In consequence of the action of the fluid flow and the weight of the anchor itself, penetration of the anchor in the ocean subsoil occurs, going through all low compaction subsoil layer and reaching the compacted subsoil layers, penetrating through to the preset depth required for the project;

e) Once the depth required for the project is reached, the fluid pumping is stopped and the hose is pulled until it releases from the central body extremity;

f) Once the hose is disconnected, the handling ship moves to a point far from the fixed area so that it may pull the cable at an angle, until it obtains consolidation of the greatest passive resistance in the portion of subsoil next to the drilled area.

BRIEF DESCRIPTION OF THE DRAWINGS

The invention will be described in greater detail, together with the related illustrations below merely as an example, which are included in the present report, of which they are an integral part, and in which:

FIG. 7 shows a Table of the valuation of load capacity of the anchoring structure applied in a first linear variation profile of the resistance of the floor by depth;

FIG. 8 shows a Table of the valuation of load capacity of the anchoring structure applied in a second linear variation profile of the resistance of the floor by depth; and FIG. 9 shows a Table of the valuation of load capacity of the anchoring structure applied in a third linear variation profile of the resistance of the floor by depth.

DETAILED DESCRIPTION OF THE INVENTION

The deep water high capacity anchoring system, object of this invention, was developed from research seeking to optimize the direct application of carrying out a principle of jetting fluid from the sustainable floor of a structural anchoring element. The application of this principle in the lower extremity of an anchor causes continuous erosion, with sustainable floor loss under the anchor area and its consequent penetration in ocean subsoil. The penetration is also influenced by the conical shape of the outside of the anchor, to facilitate the carrying as well as to guide the anchor during its vertical descent in the direction of the solid ocean floor.

In this way, the research was turned towards the development of an anchoring system that would allow a permanent anchorage, in which an anchoring structure may be embedded into the deep layers of the ocean floor, where greater passive resistance of the floor can be mobilized and reach a high resistant limit to the extract.

Figure 1:
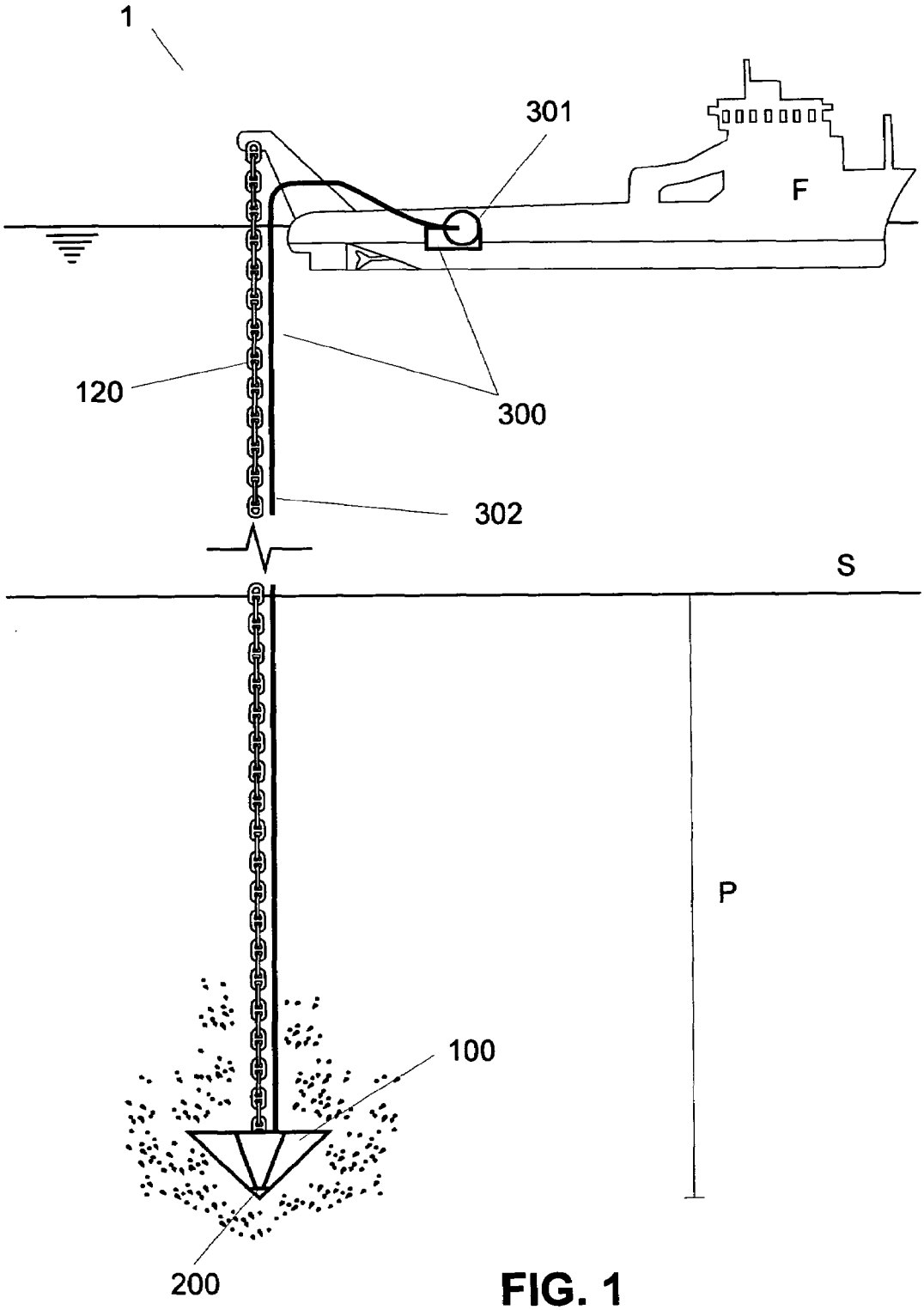
FIG. 1 shows a schematic view of the anchoring system being anchoring in the ocean floor.

As seen in FIG. 1, which shows a schematic view of the deep water high capacity anchoring system (1), the invention is basically comprised of an anchoring system (100), cables (120), a jetting device (200), a pumping system (300), a handling ship (F) from which the anchoring structure can be cast and conducted to the operation of embedding.

In short, the deep water high capacity anchoring system (1) consists of a metal anchoring structure (100) in a (preponderantly) conical form, provided with a cable (120), that is cast down to the ocean floor (S), from a handling ship (F). The handling ship, in turn, is provided with a pumping system (300), consisting of pumps (301), hose (302), and its accessories, and supplies the anchoring structure's extremity (100) with a specific and continuous flow of liquid, which causes the embedding of said anchoring structure.

The pumps may be located in the handling ship (F) itself or may be submerged. When the use of pumps located on the surface is adopted, optionally a fire pump system may be used from said handling ship (F) as a pumping method.

Thus, the liquid pumped by the pump (301) is injected through one of the extremities of the anchoring structure (100), through a hose (302), traversing the inside of the main tubular body in the anchoring structure (100) and then is expelled, in the form of a continuous and directed jet, by the other extremity of said anchoring structure, through a jetting device (200). The deep water high capacity anchoring system (1) allows liquids with density greater than, equal to, or lower than sea water.

It is also possible to see in FIG. 1, the embedded depth (P) reached by the anchoring structure (100) in the ocean floor.

According to the research performed, the embedded depth (P) must reach values higher than those currently used in the current methods and models for anchorage, that currently are around 20 m deep, in ocean floors that are not very compacted.

Figure 2:
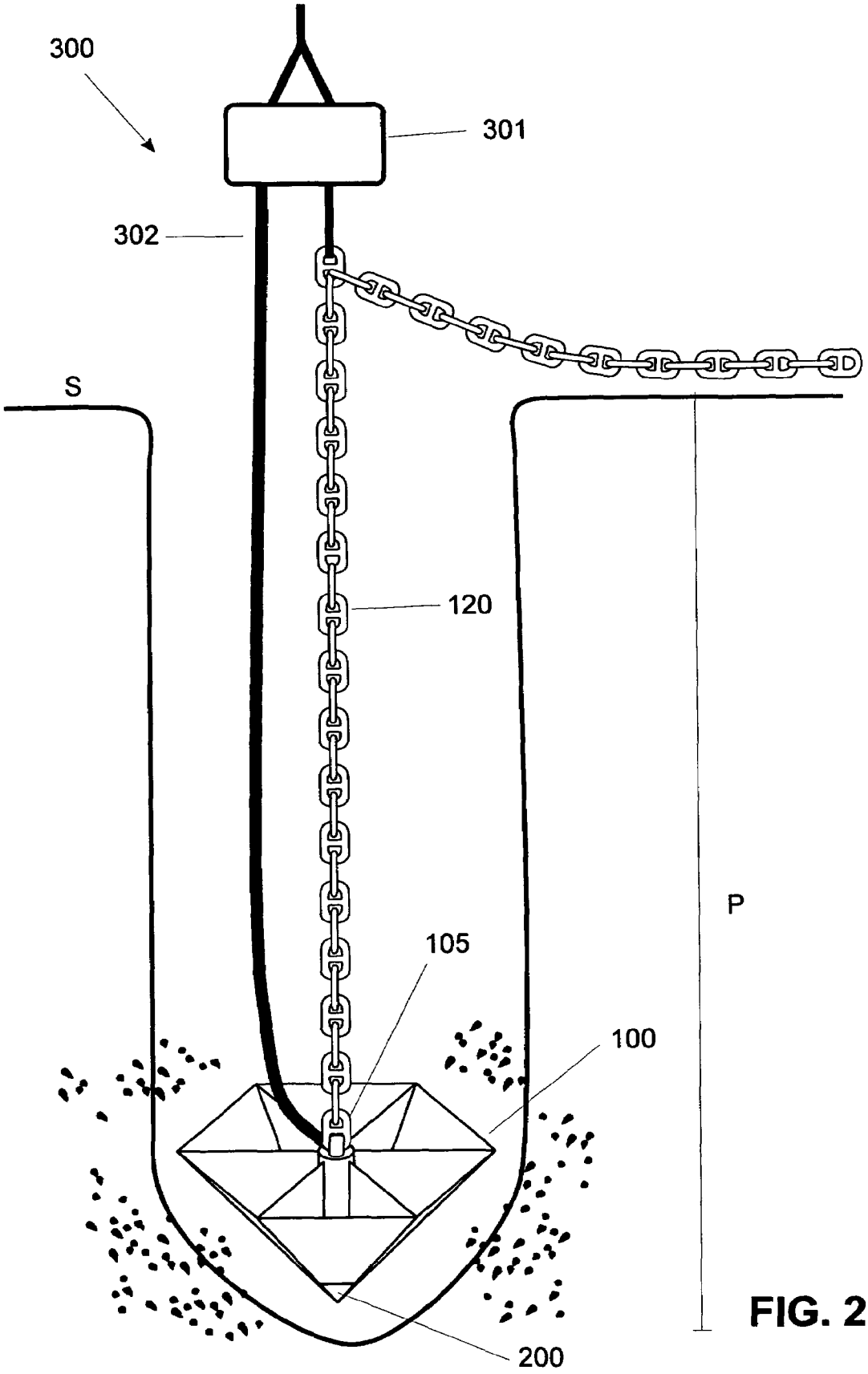
FIG. 2 shows an alternative application of submersed pumping, in schematic view of the anchoring system being anchoring in the sea bottom.

FIG. 2 shows a detailed schematic view of the preferred alternative location for the pumping system (300). Due to the purpose of applying the high capacity anchoring system (1) herein proposed, on choppy water with a depth of above 2000 m, using a submerged pumping system (300) offers great advantages, such as for example, minimizing the loss of load, dispensing the use of high capacity pumps, using hoses with thicker walls and smaller; reducing the handling volume and the handling weight of the hose reels on the handling ship, and, facilitating the operation of the anchorage no matter what are the ocean conditions, since the hoses (302) are susceptible to twisting on the ship.

Figure 3A:
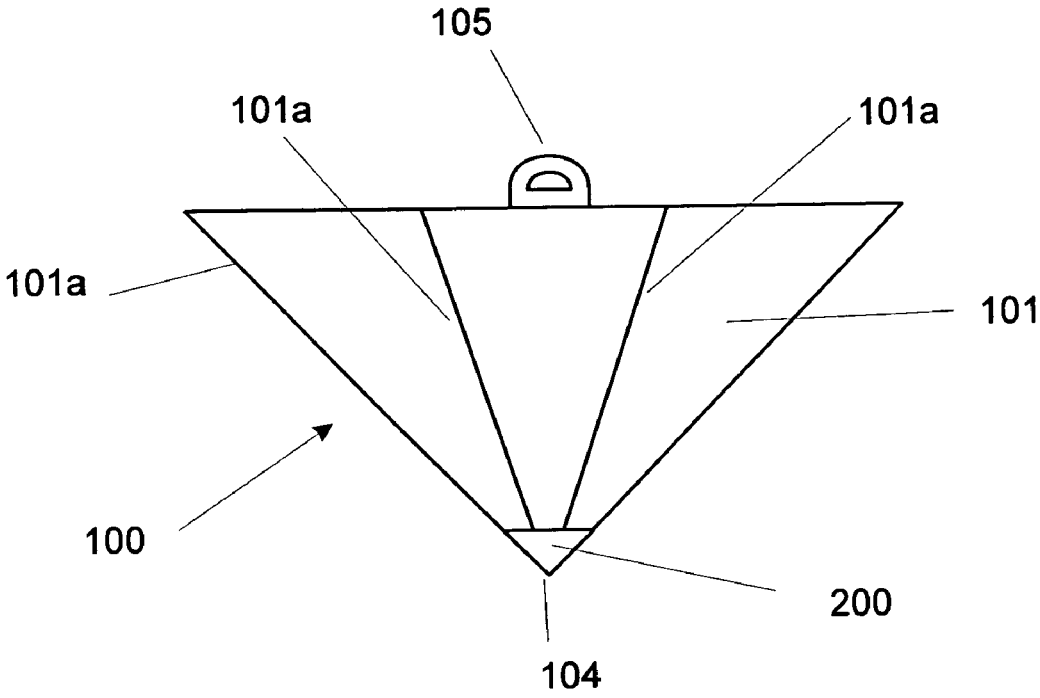
FIG. 3A shows a side view of the anchoring structure.
Figure 3B:
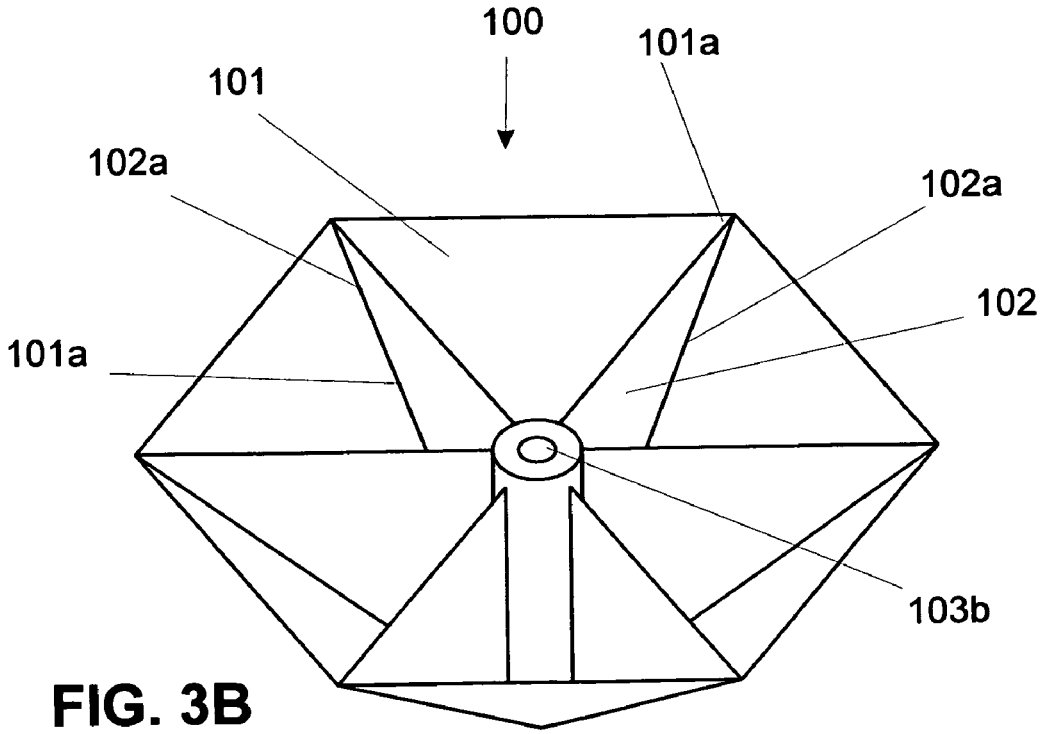
FIG. 3B shows a view in perspective of the anchoring structure.

FIGS. 3A and 3B, show a side view and a view in perspective respectively of a preferred layout for the anchoring structure (100) that should be used with the deep water high capacity anchoring system (1), object of this invention.

The anchoring structure (100) has four basic and primordial functions in the deep water high capacity anchoring system (1), which are: directing the carrying of the eroded substrate under said anchoring structure, offering little resistance to the entrenchment, while offers high breakaway resistance, and, facilitating vertical descending displacement by its own weight and the external shape tending to be conical. These four basic functions shall be detailed along the description. By virtue of these functions, the layout of the anchoring structure (100) complies with a certain minimum parameters.

To satisfy these parameters, the anchoring structure (100) must present a circular conical form, or pyramidal with at least three faces. In tests it is preferably used a pyramidal shape of six flat surfaces (101), each (one)of these surfaces have the shape of an isosceles triangle. The surfaces are interlinked by their equal edges (101*a*). Each intersection of the equal surfaces is linked by a stiffening plate (102) in a right-angle triangular form. The oblique edge (102*a*), which corresponds to the hypotenuse of the right angle triangle, of the stiffening plate (102) is welded at the intersection of the equal edges (101*a*) that joins the two contiguous flat surfaces (101). One of the straight edges (102*b*) of this stiffening plate (102), corresponding to one of the legs, is welded to a central body (103), and aligned with its vertical axis.

The central body (103) is preferably made up by one segment of metal tubing that extends vertically from the apex (104) of the inverted pyramid formed by the union of the flat surfaces (101), up to a height corresponding to the base of said pyramid. The central body (103) is located inside the pyramid, and, in the central body, coincident with the apex (104), the tip is attached to the anchoring structure (100), containing a jetting device (200).

The free extremity (103*b*) of said central body is provided with an anchor ring (105) and a mean for releasing and fixing a hose (302) (not shown). An anchor chain (120) is fixed to the anchor ring (105) shown in FIG. 1.

Figure 4:
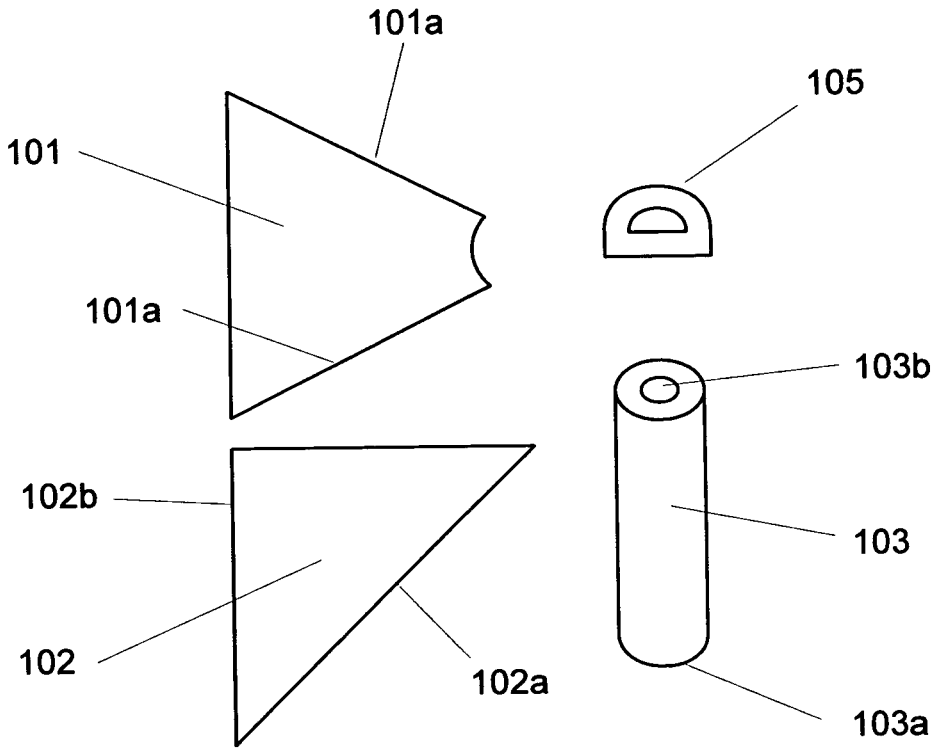
FIG. 4 shows in exploded view the main elements of the anchoring structure.

The components of the anchoring structure (100): flat surface (101) with their equal edges (101*a*), stiffening plate (102) with oblique edge (102*a*) and vertical edge (102*b*), central body (103), and anchor ring (105), may be best seen in the exploded illustration in FIG. 4. In this FIGURE, it is easy to see the simplicity of the build of the structure, once, using this preferred configuration, the majority of its components may be obtained from flat plates, all interlinked by welding them together and/or to the tubular central and the anchor ring.

The use of only flat plates and a central tube with an anchor ring makes the total cost of the anchoring structure (100) lower, in comparison with the other anchors used in the anchorage of large floating structures, especially in petroleum platforms.

Figure 5:
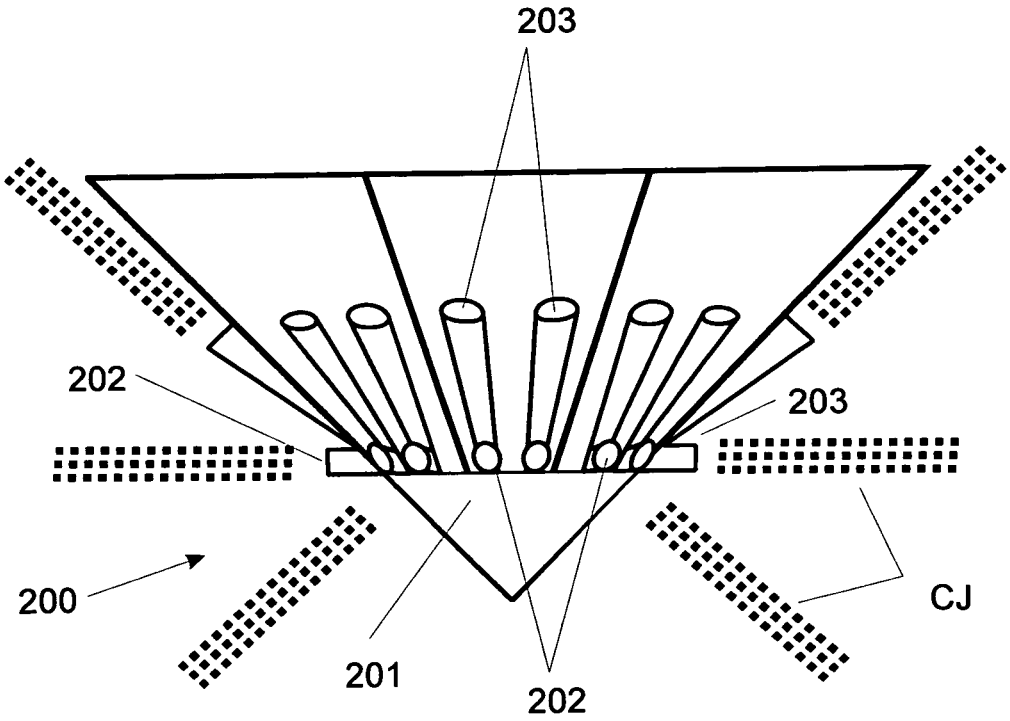
FIG. 5 shows the jetting device in detail.

FIG. 5 details the jetting device (200) located in the apex (104) of the anchoring structure (100).

The jetting device (200) consists of a directional conical tip (201), which is metallic and solid that connects to the lower extremity (103*a*) of the central body (103), sealing it. The directional conical tip (201) is provided with a series of openings or nozzles (202) placed perpendicular to the main axis of the central body (103), along the entire perimeter of the jetting device (200). The jetting, in a radial direction to the vertical axis of the anchoring structure (100), facilitates the separation of the compacted layers of the ocean floor under the salient area of the cone-shape of said structure, facilitating its penetration. The radial jets tend to move the ocean floor particles away from the penetration area, facilitating the descent of the anchoring structure by it's own weight.

As an option, these openings (202) may be placed in an interlinked position that is perpendicular to the external surface of the directional conical tip (201). The function of these openings or nozzles (202), placed perpendicular to the external surface of the directional conical tip (201), is to eject directed the pressurized liquid into the inside of the central body (103), in order to generate a cup shaped curtain of liquid jets, in the opposite direction of the conical anchoring structure (100), turned directly towards the ocean floor (S).

The cup shaped curtain of liquid jets (CJ) acts as a drill disaggregating the ocean substrate and also causes a loss of ocean floor support for the anchoring structure (100).

As another option, the direction of the openings or nozzles may be changed to a radial direction in relation to the vertical axis alternating with various angles in relation to this axis, objectifying maximize the separation of the ocean floor underlying the anchoring structure.

Simultaneously, a second series of openings or nozzles (203), which are placed along the entire perimeter of the jetting device (200), have their outlets turned towards the apex, in order to release the fluid in an ascending direction parallel to the lower external surface of the anchor (201), directing upwards the pressurized liquid into the inside of the central body (103).

This series of openings or nozzles (203) is important for the system now being proposed, because the flow of liquid generated by them flows parallel to the flat surfaces (101) in order to erode and separate the ocean floor substrate, besides reducing friction between these surfaces and the ocean floor.

This flow parallel to the surfaces also contributes with the upwards carrying of said anchoring structure, and outwards from the cavity that is being formed in the separated substrate by the assembly of jets set radial from the vertical axis of the structure, or by any of the jets generated by the directional conical tip (201).

It is important to stress that there must be a balance between the total diameter of the anchoring structure (100) and the angle ($\phi$) of placement of the flat surfaces (101) of the device with the horizontal. The convex side of the anchoring structure (100), which is turned towards the cavity in the ocean floor (S) which is being formed, must present a proper degree of penetration, and the concave side must have a total area sufficient to mobilize enough mass of the ocean substrate in order to attain the resistance to the desired breakaway in the project. Thus, the angle ($\phi$) gives greater equilibrium between these two objectives, when they are within a range between 30° and 60°.

The diverse advantages inherent to the deep water high capacity anchoring system (1) proposed shall become evident upon developing the description of the method of use, based on the stages presented in FIGS. 6A to 6E.

Figure 6A:
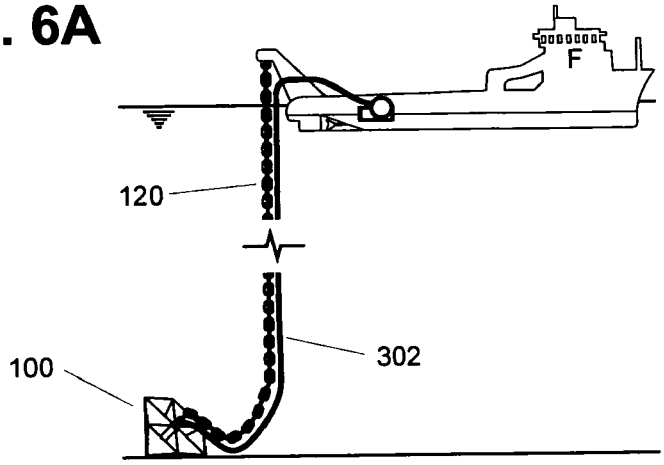
FIGS. 6A to 6E show stages of the operational method.

In accordance with FIG. 6A that shows the first stage of the preferred method, the anchoring structure (100) attached to a cable (120) is thrown from any handling ship (F). The cable (120) must be released up to the anchoring structure (100) be totally supported on the ocean floor (S) and said cable be loose or partially lying down on the ocean floor.

It is important that the cable be lowered with a length that exceeds the depth of the operation, so that during the fixing process no tension occurs along the cable due to the natural fluctuation of the handling ship (F), which could cause possible damages to its winch.

This stage is much less complex than it would be to cast a suction anchor, for example. From the operational point of view this type of anchor offers a large structure and it is difficult to handle, and from the technical resources point of view, casting a suction anchor requires ships equipped with a positional stabilizer and a vertical oscillation compensator. Therefore, by examining the first stage of the system proposed, it can be seen that it is totally unnecessary to use handling ships provided with these stabilization systems.

Figure 6B:
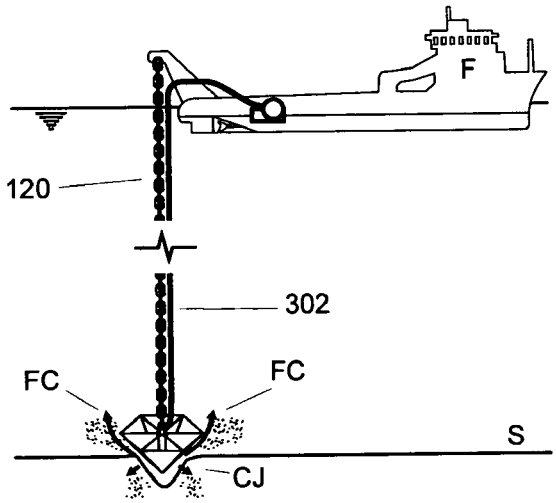

Once the anchoring structure (100) is completely supported on the ocean floor (S), the second stage is begun, as shown in FIG. 6B. The pumping system (300) is activated, which pumps a liquid through pumps (301) and a hose (302) to an extremity (103*b*) of the anchoring structure (100), maintaining the pressurization of the inside of its central body (103).

With the beginning of pressurization, the fluid jets are generated in the area of the extremity (104) of the anchoring structure (100). Due to the center of gravity of the anchoring structure (100) being located approximately at ⅔ of the apex (104), as the initial jetting causes a cavity in the ocean floor (S), said anchoring structure (100) will have a tendency to rotate until it inserts itself vertically into the cavity that is being formed.

The third stage, as shown in FIG. 6B, is begun with pressurizing the liquid inside the central body (103). In this stage, two flows of liquid are generated from the jetting device (200), preferably flowing in two different directions: an interior flow, in the shape of a cup (CJ) or of jets radially positioned in relation to the vertical axis or even at different angles, that are aimed directly towards the ocean floor (S), resulting in a continual erosion of the ocean floor, with a loss of support from the ocean floor under the salient area of the anchoring structure. The other flow (FC), contiguous to the external surface of the anchoring structure (100) and turned towards the apex, besides separating and carrying the substrate revolved or not by the lower flow (CJ) it reduces friction between this surface and the ocean floor, and transports the revolved substrate upwards.

Figure 6C:
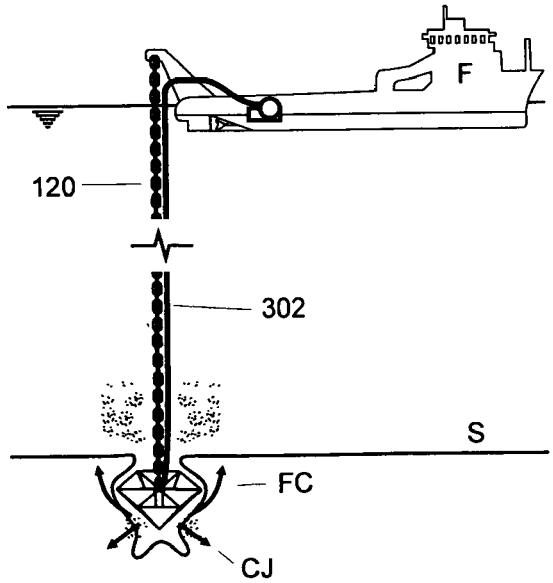

Consequently the action of these two liquid flows and of the weight of the anchoring structure (100) itself, penetration of the anchor into the ocean subsoil occurs, which is shown in FIG. 6*c*.

Figure 6D:
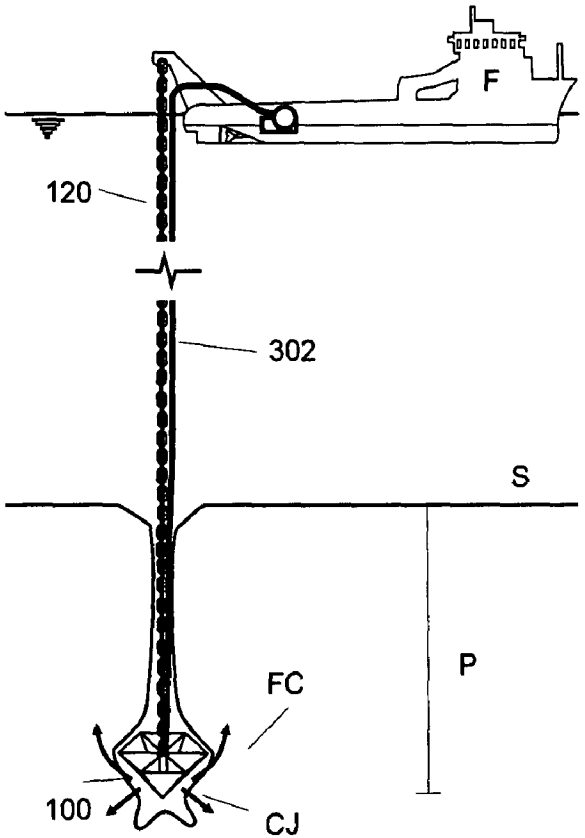

The fourth stage, shown in FIG. 6*d*, the continuous erosion fixing operation combined with transporting the sediment is performed with the concomitant inlet of pressurized liquid with the descent of the cable (120), up to the time that the anchoring structure (100) passes through all the unconsolidated and/or few-compacted subsoil layers, and reaches the compacted subsoil layers, penetrating them to the pre-defined depth (p) pre-determined by the project.

Once the depth required for the project is reached, the next stage consists of stopping the pumping of the liquid and the hose (302) is pulled until it releases from the central body (103) extremity (103*b*).

As an option, the hose (302) may be provided with a quick release coupling in the extremity of the outcropping next to the sea bed. In this case, when pulling the hose, it will be uncoupled at the quick release coupling, on the sea bed, discarding the fix ed section together with the anchoring structure (100).

Figure 6E:
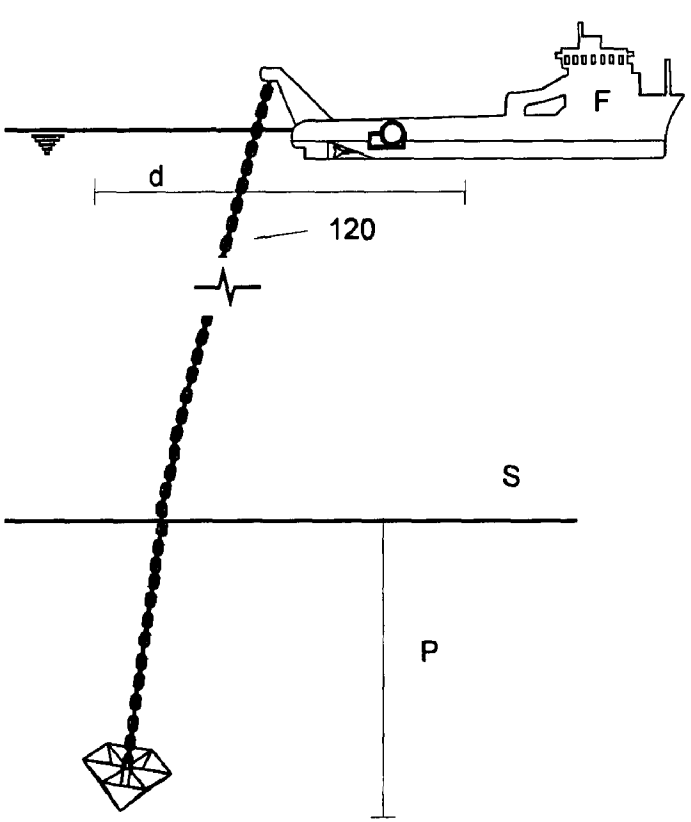

The sixth and last stage, shown in FIG. 6E, consists of the displacement of the handling ship (F) to a point removed from the location of the excavation, in order to pull the cable (120) at an angle, and consequently consolidate a higher passive resistance in the portion of subsoil contiguous to the drilled area, in which the layers are more compacted, attaining thusly a high breakaway limit.

The purpose of this final operation is also, by pulling the anchor in the region excavated in the ocean floor, to provide by rotation combined with displacement, the alignment of the longitudinal axis of the cylindrical central body (103) of the anchoring structure (100) with the application direction of transporting the cable (120) through the anchor ring (105).

The greatest development presented by the object of this invention is to provide an anchoring system capable of reaching great depths in the ocean floor, in such a way that it mobilizes a passive thrust into layers of great resistance, base on a simple procedure and using a light and inexpensive anchoring element.

By itself, the differential of weight, which is characteristic of the equipment proposed, making easy handling possible during any stage of the fixing operation. For example, the weight of an anchoring structure (100) can reach around 5 tons, which is much lower when compared with the 98 tons of a torpedo anchor, or even the 10 tons of a drag anchor.

As an example of the application of the anchoring system of this invention, a pre-estimate of the load capacity of the anchoring structure (100) on clay type ground, where it may be cast by hand according to the following equation:

$$Qu=10.(Su/10).A[t] \quad (1)$$

Where:

Qu=load capacity against breakaway, in tons,

Su=shear resistance of clay ($KNm^2$),

A=salient zone perpendicular to the direction resultant of the sediment ($m^2$).

θ=diameter of the inverted base (m)

The shear resistance (Su) in clay basically varies with the depth. Based on geotechnical profiles found up to now for anchorage of Brazilian platforms, the following equation can be considered for this valuation:

$$Su=5+2z[KNm^2] \quad (2)$$

Where:

z=depth of the load application point (m).

Merely as an illustration, Table 1 presented in FIG. 7, gives calculations for the load capacity of the anchoring structure (100) using the equations (1) and (2) (considered a preponderant circular projection of the anchoring structure).

Tables 2 and 3, presented in FIGS. 8 and 9, respectively, show the considerations for the shear resistance (Su) in the valuations of the anchor's load capacity.

In Tables 1, 2, and 3, it is important to point out that the elevated diameters of the anchoring structure (100), as well as greater resistance to the soil, tend to make the anchor installation more difficult, this difficulty should be dealt with properly way with a proper jetting system for each application of the anchoring system (1) herein proposed.

The reduction in costs which come with the implementation of this anchoring system when applied in stationary production units (UEP's), or other floating structures, eliminates all the inherent limitations and expenses of the equipment and methods currently known.

Upon adopting the deep water high capacity anchoring system (1) with the implementation of an anchoring structure (100), it will remain embedded until the end of the floating structure's useful life, mobilizing strength in compacted layers of the ocean subsoil, generally located at greater depths than conventional systems. According to data presented in the Tables, it is possible to make excavations viable in depths within a range of 25 to 40 meters.

The invention has been described herein with reference made to its preferred final applications. However, it must be clarified that the invention is not limited to only these applications, and those with technical abilities will immediately realize that alterations and substitutions may be made within the concept of this invention here described.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. Deep water high capacity anchoring system, which includes a metal anchoring structure in a preponderant conical form, provided with a cable, cast on an ocean floor from a handling ship, provided with a pumping system that supplies one of the extremities of the anchoring structure, with a flow of liquid, through a hose, and additionally characterized by the anchoring structure presenting four basic and main functions:

1-directs the upward movement of an eroded substrate under said anchoring structure, 2-offers little resistance to fixing the anchor, 3-at the same time offering high resistance to extraction, 4-propitiating its own descending vertical displacement using its own weight and an external shape thereof, which is generally conical; by virtue of these functions, a layout of the anchoring structure complies with certain minimum parameters, including presenting a conical circular shape, or pyramidal shape with no fewer than three faces; an angle (ϕ) of placement of the external surfaces of the anchor structure with respect to horizontal being within a range of 30° to 60°; said anchor structure being provided with a central body made up by a segment of metal tubing that extends vertically from an apex of said anchor structure up to a height corresponding to its inverted base; in the central body, coincident with the apex, a directional conical tip is attached to the anchoring structure, which is provided with a jetting device; the other extremity of said central body is provided with an anchor ring and a means for coupling the hose; the anchor ring will be fixed to the cable; a fluid is injected into the other extremity of the central body structure, through the hose, through the inside of the main tubular body, and is expelled, in the form of a continuous and directed jet, through the jetting device; said jetting device comprising the directional conical tip, which is metallic and connects to the lower extremity of the central body, sealing it; the directional conical tip is provided with a series of openings or nozzles placed perpendicular to the main axis of the central body, along the entire perimeter of the jetting device; simultaneously, a second series of openings or nozzles placed along the entire perimeter of the jetting device, which have their outlets turned towards the apex, so as to release the fluid in an ascending direction parallel to the lower external surface of the anchor structure; the pumping system consists of pumps and the hose; the pumps may be located in the handling ship itself, or submerged; the liquid pumped by the pump may have a density that is greater than, equal to, or less than that of sea water.

2. Deep water high capacity anchoring system, in accordance with claim 1, characterized by a pyramidal form of six flat surfaces, each one of these surfaces have the shape of an isosceles triangle; the surfaces are interlinked by their equal edges; each intersection of the surfaces is shackled by a stiffening plate in a right-angle triangular form; one of the oblique edges, corresponding to an hypotenuse of a right-angle triangle, of the stiffening plate is welded to the intersection of the equal edges that joins two contiguous flat surfaces and one of a straight edge of the same stiffening plate, corresponding to one of the legs, being welded perpendicularly to a central body, aligned with its vertical axis; the central body being made up by one segment of metal tubing that extends from the apex of the pyramid up to a height corresponding to the inverted base of the pyramid; in the apex of the central body attached the tip of the anchoring structure, containing the jetting device; the other extremity of said central body being provided with said anchor ring and a medium for coupling the hose; the anchor ring is fixed to the cable.

3. Deep water high capacity anchoring system, in accordance with claim 1, characterized by the jetting device comprising the directional conical tip, metallic and solid that connects to the lower extremity of the central body, sealing it; the said directional conical tip is provided with a series of openings or nozzles placed perpendicular to the main axis of the central body, along the entire perimeter of the jetting device; simultaneously, a second series of openings or nozzles, placed along the entire perimeter of the jetting device having their outlets turned towards the apex, so as to release the fluid in an ascending direction parallel to the lower external surface of the anchor, directing a pressurized liquid into the inside of the central body towards the apex.

4. Deep water high capacity anchoring system, in accordance with claim 3, characterized by the jetting device presenting a series of openings or nozzles, placed perpendicular to the external surface of the directional conical tip, in order to eject the pressurized liquid direct into the inside of the central body, generating a cup shaped curtain of liquid jets, in the opposite direction of the conical anchor structure.

5. Deep water high capacity anchoring system, in accordance with claim 3, characterized by the jetting device presenting a series of openings or nozzles which are placed perpendicularly to the main apex of the central body, linked to a second series of openings or nozzles placed perpendicularly to the external surface of the directional conical tip.

6. Deep water high capacity anchoring system, in accordance with claim 3, characterized by the jetting device further presenting the openings or nozzles direction in a radial position to the vertical axis alternating with openings or nozzles placed at different angles in relation to this axis.

7. Deep water high capacity anchoring system, in accordance with claim 1, characterized by a fire pump system used from said handling ship as a pumping method.

8. Deep water high capacity anchoring system, in accordance with claim 1, characterized by adopting a submerged pumping system.

9. Operational method for high capacity deep water anchoring system in accordance with claim 1, characterized by proceeding through the following stages:

a) a single handling ship casts the anchor structure connected to the cable, the cable being released up to the time that the anchor structure is totally supported on the ocean floor and said cable be loose or partially lying down on the ocean floor;

b) once the anchor structure is completely supported upon the ocean floor, the pumping system is activated, which pumps a liquid through pumps and the hose injecting the fluid to an extremity of the anchor structure, maintaining the fluid pressurized in the inside of its central body;

c) with the beginning of pressurizing, consequently fluid jets are generated in the extremity area of the anchor structure, making a cavitation in the ocean floor; said anchor structure will rotate until it inserts itself vertically in the cavity that it being formed;

d) as a consequence of the action of the two main liquid flows and of the proper weight of the anchor structure, penetration of the anchor into the ocean subsoil occurs; pumping of the fluid is maintained concomitantly with the descent of the cable, up to the time that the anchor structure passes through all soft and/or low compaction subsoil layer and reaches compacted subsoil layers, penetrating them to a pre-defined depth for a project;

e) once the depth required for the project is reached, the fluid pumping is stopped and the hose is pulled until it releases from the central body extremity; or optionally, in a quick release coupling to the hose, in a position coinciding with the height of a sea bed;

f) once the hose is disconnected, the handling ship moves to a point that is distant to the penetrated anchor structure, so that it may pull the cable at an angle, until it obtains consolidation of the greatest passive resistances in the portion of the subsoil next to a drilling area, and reaches a high breakaway limit; at the same time occurs by rotation combined with displacement, the alignment of the longitudinal axis of the cylindrical central body of the anchor structure with the direction of carrying application by the cable in the anchor ring.

* * * * *